US005285592A

United States Patent [19]

Sides

[11] Patent Number: 5,285,592

[45] Date of Patent: Feb. 15, 1994

[54] MOTOR CASE WITH COMPOSITE OVERWRAP AND METHOD

[75] Inventor: James R. Sides, Oakton, Va.

[73] Assignee: Atlantic Research Corporation, Vienna, Va.

[21] Appl. No.: 784,874

[22] Filed: Oct. 31, 1991

[51] Int. Cl.[5] ..... F41A 21/02

[52] U.S. Cl. ..... 42/76.02; 89/15; 89/16; 60/253; 156/153

[58] Field of Search ..... 42/76.01, 76.02; 89/15, 89/16; 60/253; 156/153, 169, 172, 166, 187, 192, 195

[56] References Cited

U.S. PATENT DOCUMENTS

| | | | |
|---|---|---|---|
| 2,228,332 | 3/1937 | Wick et al. | 156/153 |
| 2,847,786 | 8/1958 | Hartley et al. | 42/76.02 |
| 3,517,585 | 6/1970 | Slade | 89/15 |
| 4,646,615 | 3/1987 | Gladstone et al. | 89/15 |
| 4,655,866 | 4/1987 | Ferrier | 89/15 |
| 4,669,212 | 6/1987 | Jackson et al. | 42/76.02 |
| 4,685,236 | 8/1987 | May | 42/76.02 |
| 5,024,711 | 6/1991 | Gasser et al. | 156/153 |
| 5,038,561 | 8/1991 | Chase | 60/254 |
| 5,054,224 | 10/1991 | Friar et al. | 42/76.02 |

*Primary Examiner*—Michael J. Carone
*Attorney, Agent, or Firm*—Frank P. Presta

[57] ABSTRACT

A motor case, including an aluminum barrel and a composite overwrap wound around the barrel to form a composite layer, which protects the operator against case failure during motor firing due to thermal effects caused by insulator defects or the like. The overwrap is formed of a fibrous material and a low temperature curable resin, the overwrap being mechanically bonded to the barrel. The method includes the steps of imparting texture to the outer surface of the barrel, wherein the textured surface includes jagged protrusions extending outwardly therefrom, wrapping an strip of fibrous material impregnated with a low temperature curable resin around the barrel, and curing the case.

11 Claims, 1 Drawing Sheet

MOTOR CASE WITH COMPOSITE OVERWRAP AND METHOD

BACKGROUND OF THE INVENTION

The present invention relates to a motor case provided with a composite overwrap which protects against case failure due to thermal effects caused by insulator defects or the like, and a method of manufacturing same.

Aluminum has become a desirable material for use in motor cases due to its light weight and durability under normal firing conditions. It is well known that aluminum can be successfully used for motor cases by employing an insulator, such as a sleeve silica phenolic material or the like, which is bonded to the inside of the case to protect the case from overheating when fired. However, such insulators can become cracked due to, for example, adhesive voids between the insulator and the case which allow the insulator to expand outwardly under pressure from motor firing, thereby exceeding the strain capacity of the insulator material. Cracks in the insulator can result in catastrophic case failure upon motor firing due to degradation in the case strength from case overheating caused by propellant gas flow through the cracked insulator. Case failure can result in serious injury or death to personnel in the vicinity of the case.

Therefore, a need has been created for an aluminum man-rated motor case which will not fail due to thermal effects caused by insulator defects or the like, and thereby will maintain safety for the operator and other personnel. The motor case including the composite overwrap and method of manufacture of the present invention meet this need.

BRIEF DESCRIPTION OF THE PRIOR ART:

Various procedures have been incorporated in motor case and insulator manufacturing to minimize the occurrence of insulation defects which could result in case failure. These procedures have included, for example, improved manufacturing techniques for reducing adhesive voids, inspection techniques for identifying adhesive voids and establishment of adhesive void size criteria. Although such procedures have helped in reducing the occurrence of case failure due to insulation cracks, they have not eliminated the occurrence of defects, and therefore do not provide sufficient assurance that operator safety will be maintained.

Various composite firearm barrels are also known in the patented prior art as evidenced by the patent to Hartley No. 2,847,786, which discloses a firearm barrel including a liner and a jacket, in which the jacket is made of fiber reinforced resin and is formed by winding the fiber reinforced resin on the liner and bonding it thereto. While the prior art discloses the use of composites in firearm barrels, it does not provide a safe and effective motor case which lends itself to an easy and reliable method of manufacture.

SUMMARY OF THE INVENTION

Accordingly, it is a primary object of the present invention to provide a motor case particularly for man-rated rocket motor launchers which will not fail when exposed to internal thermal effects due to insulation defects or the like, thereby to insure operator safety.

Another object of the invention is to provide a motor case comprising an aluminum barrel and a composite overwrap wound around the barrel forming a layer which protects against case failure caused by thermal effects, wherein the overwrap includes an elongated strip of fibrous material impregnated with a low temperature curable resin.

A further object of the invention is to provide a method of manufacturing a motor case having an aluminum barrel comprising the steps of bombarding the barrel with hard particles at high velocity to impart texture, including jagged protrusions, on the outer surface of the barrel, wrapping an elongated strip of composite material around the barrel to form a protective layer and curing the case.

DESCRIPTION OF THE FIGURE

Other objects and advantages of the subject invention will become apparent from a study of the following specification when viewed in the light of the accompanying drawing, in which.

DETAILED DESCRIPTION

Figure 1:
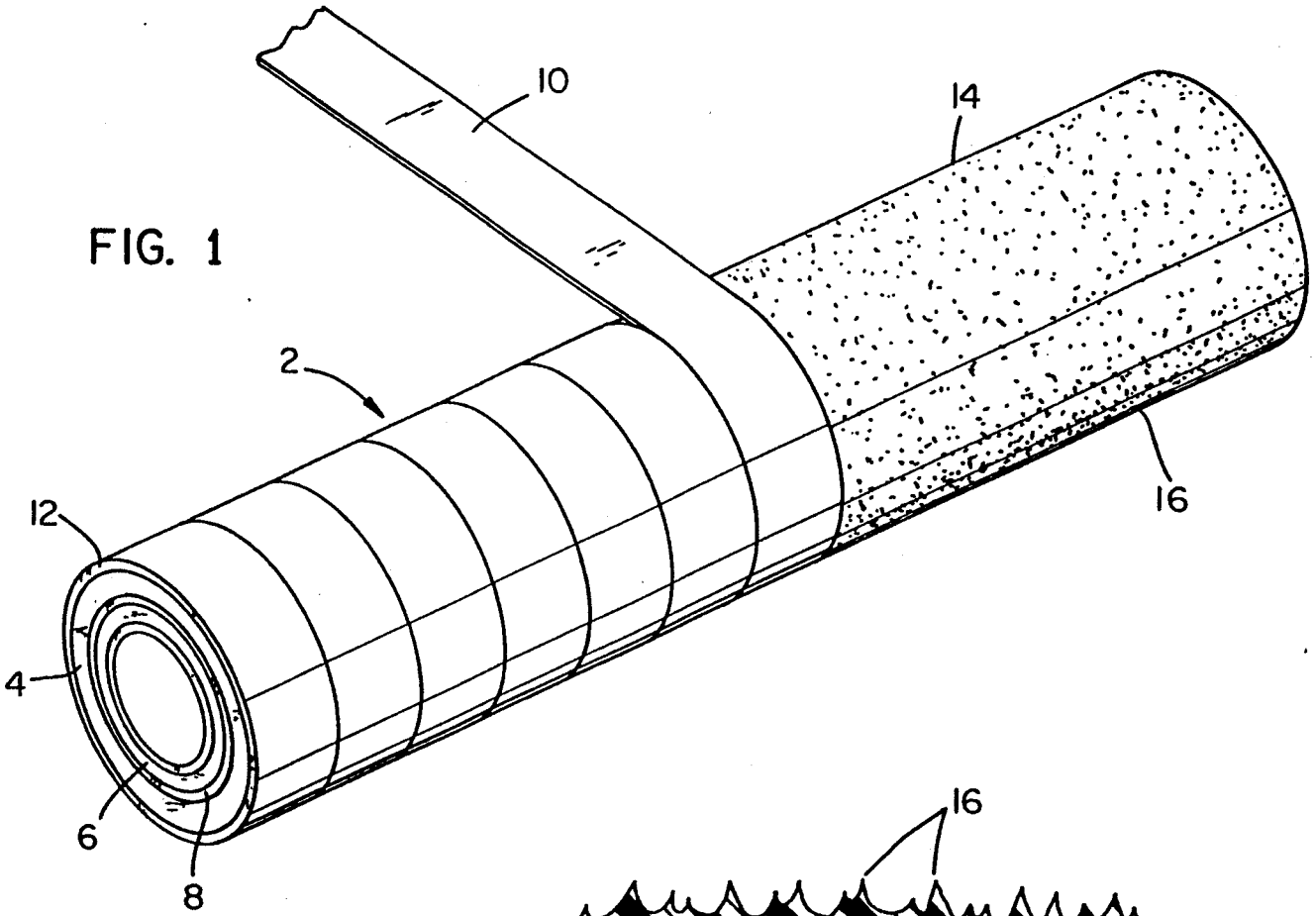
FIG. 1 is a perspective view of the motor case of the present invention in which the composite overwrap is in the process of being wound around the aluminum barrel.

Referring to FIG. 1, there is shown the motor case 2 of the present invention, including an aluminum barrel 4, an insulator sleeve 6 bonded to the inside surface of the barre 4 with an adhesive layer 8, and a composite overwrap 10 wound around the outer surface 14 of the barrel 4 forming a composite layer 12.

The motor case 4 of the present invention will not catastrophically fail upon motor firing due to thermal effects caused by cracks or other defects present in the insulator 6. The insulator 6 may be any known suitable insulating material such as silica phenolic or the like. The adhesive layer 8 may be any known suitable adhesive such as an epoxy adhesive or the like.

The overwrap 10 is formed of a fibrous material, either cloth or unidirectional type, impregnated with any suitable low temperature curable resin. Preferably the fibrous material is formed of KEVLAR ® material and the resin is a Shell 9410/9450 resin available from Shell Oil Company. The resin should be curable at a temperature of approximately 170° F. or below, to minimize the adverse effects resulting from the expansion and contraction of the aluminum barrel 4 when the resin is cured on the case. The overwrap 10 may be wound on the case 4 to any suitable thickness which will provide the desired protection against thermal effects due to insulation defects. For a typical man-rated rocket launch motor case, such as the AAWS-M motor case, the composite overwrap layer 12 preferably is 12–15 millimeters thick, thereby adequately maintaining operator safety.

Figure 2:
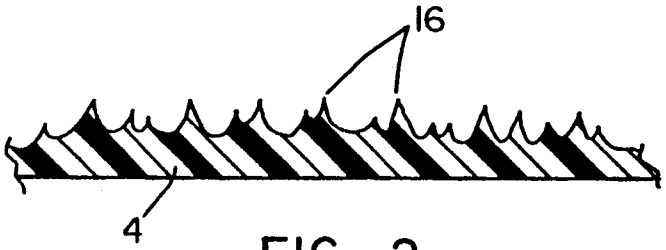
FIG. 2 is an enlarged sectional view of the textured surface of the barrel 4 of FIG. 1, including the jagged protusions 16.

The barrel 4 preferably is formed of aluminum, but any other suitable lightweight material may be used. The overwrap 10 may be used on any existing motor case to provide additional protection from case failure. As shown in FIG. 2, the outer surface 14 of the case 4 preferably is textured, wherein the textured surface includes jagged protrusions 16 extending outwardly therefrom. The protrusions 16 cooperate with the fibrous material in the overwrap 10 to mechanically bond the composite layer 12 with the barrel 4, thereby eliminating the need for an adhesive to be used for bonding therewith, and reducing the chance that the overwrap 10 will delaminate.

In accordance with the invention, a method of effectively and economically manufacturing a motor case has been provided, wherein the motor case 2 includes an aluminum barrel 4 and an overwrap layer 12. The method includes the steps of imparting texture to the outer surface 14 of the barrel 4, wherein the texture includes jagged protrusions 16 extending outwardly therefrom, wrapping an elongated strip 10 of fibrous material impregnated with a low temperature curable resin around the barrel 4 to form a protective composite layer 12 and curing the case 2. The texture may be imparted by bombarding the outside surface 14 of the case with hard particles, such as steel shot or the like, at high velocity to crater the surface thereby forming the jagged protrusions 16. The overwrap 10 may be applied on the barrel 4 through the use of a mandrel or the like. Preferably, the overwrap 10 is wound on the barrel 4 in helical configuration with two hoop wraps to form a composite layer 12 having a thickness of approximately 12–15 millimeters. The case should be cured at a temperature of approximately 170° F. or below, to minimize expansion and contraction of the barrel 4 during curing in order to maintain tight contact between the overwrap 10 and the barrel 4.

To verify the effectiveness of the motor case of the present invention against case failure due to overheating, the following tests were performed. A motor case was constructed in which the insulator was bonded to the case only at the forward and aft ends over a length of 0.5 inches, and leaving an open radial gap between the insulator and the case. No overwrap was provided on the case. The motor was fired, and the case catastrophically ruptured at a pressure of 3600 psi approximately 0.060 seconds into the firing.

Another motor case with the same insulation installation as described above was tested, except that the case was provided with a KEVLAR ®/epoxy overwrap in accordance with the present invention and method. The motor firing was completed successfully with no case rupture. After firing, the case was sectioned for inspection. The insulator showed massive cracking along its length, and soot and heating effects were visually observed on the inside of the aluminum barrel. Hence, the benefits of the motor case having the composite overwrap and method of manufacture of the present invention were clearly demonstrated.

While in accordance with the patent statute, the preferred forms and embodiments of the invention have been illustrated and described, it will be apparent to those of ordinary skill in the art that various changes and modifications may be made without deviating from the inventive concepts set forth above.

What is claimed is:

1. A motor case comprising a tubular barrel having an outer surface and a composite overwrap wound around said outer surface forming a layer which protects against case failure caused by thermal effects, said overwrap including an elongated strip of fibrous material impregnated with a curable resin, and further wherein said outer surface of said barrel is textured such that there are jagged protrusions extending outwardly therefrom, said protrusions cooperating with said fibrous material to mechanically bond said overwrap to said barrel.

2. A motor case as defined in claim 1, wherein said fibrous material is KEVLAR ® material.

3. A motor case as defined in claim 1, wherein said resin is curable at a temperature of approximately 170° F.

4. A motor case as defined in claim 1, wherein said overwrap layer is 12–15 millimeters thick.

5. A motor case as defined in claim 1, wherein said barrel is formed of aluminum.

6. A motor case as defined in claim 5, wherein said curable resin is curable at a temperature of approximately 170° F. or below, thereby enabling said resin to be cured without causing substantial expansion and contraction of said aluminum barrel.

7. A method of manufacturing a motor case having an aluminum barrel, comprising the steps of imparting texture to the outer surface of the barrel in the form of jagged protrusions extending outwardly therefrom, wrapping an elongated strip of fibrous material impregnated with a curable resin around said barrel to form a composite protective layer thereon, and curing said case.

8. A method as defined in claim 7, wherein the step of imparting texture includes bombarding said outer surface with hard particles at high velocity.

9. A method as defined in claim 8, wherein the bombarding step includes bombarding the outer surface of the barrel with steel shot.

10. A method as defined in claim 7, wherein the case is cured at a temperature of approximately 170° F.

11. A method as defined in claim 7, wherein the wrapping step includes wrapping the material on said barrel to form a composite layer having a thickness of approximately 12–15 millimeters.

* * * * *